United States Patent [19]

Anthes et al.

[11] Patent Number: 5,000,840

[45] Date of Patent: Mar. 19, 1991

[54] CATALYTIC DEWAXING LUBRICATING OIL STOCK DERIVED FROM OLIGOMERIZED OLEFIN

[75] Inventors: Robert J. Anthes, Hamilton Square; Ross A. Kremer, Ringoes, both of N.J.

[73] Assignee: Mobil Oil Corporation, Fairfax, Va.

[21] Appl. No.: 299,856

[22] Filed: Jan. 23, 1989

[51] Int. Cl.[5] ..... C10G 47/16

[52] U.S. Cl. ..... 208/111; 585/329; 585/517; 585/533

[58] Field of Search ..... 585/329, 517, 533; 208/111

[56] References Cited

U.S. PATENT DOCUMENTS

| | | | |
|---|---|---|---|
| 4,222,855 | 9/1980 | Pelrine et al. | 208/111 |
| 4,414,423 | 11/1983 | Millor | 585/533 X |
| 4,508,780 | 2/1980 | Hsia Chen et al. | 585/517 |
| 4,520,221 | 5/1985 | Hsia Chen | 585/533 X |
| 4,554,065 | 11/1985 | Albinson et al. | 208/59 |
| 4,777,316 | 10/1988 | Harandi et al. | 585/517 |
| 4,853,527 | 8/1989 | Page et al. | 585/517 X |
| 4,870,038 | 9/1989 | Page et al. | 502/62 |

*Primary Examiner*—Glenn Caldarola
*Assistant Examiner*—E. D. Irzinski
*Attorney, Agent, or Firm*—Alexander J. McKillop; Charles J. Speciale; Laurence P. Hobbes

[57] ABSTRACT

A waxy component-containing lubricating oil stock derived from the multi-stage catalytic oligomerization of a lower olefin such as propylene is subjected to selective catalytic hydrodewaxing in the presence of certain acidic zeolites, e.g., H-ZSM-23 and H-ZSM-35, preferably associated with a hydrogenation component such as platinum, palladium or zinc, to provide a high viscosity, low pour point lubricating oil product.

18 Claims, No Drawings

CATALYTIC DEWAXING LUBRICATING OIL STOCK DERIVED FROM OLIGOMERIZED OLEFIN

CROSS REFERENCE TO RELATED APPLICATION

This application relates by subject matter to commonly assigned, copending U.S. patent application Ser. No. 140,361, filed Jan. 4, 1988, the contents of which are incorporated by reference herein.

BACKGROUND OF THE INVENTION

This invention relates to the manufacture of high quality lubricating oils and, in particular, such oils based on oligomerized lower olefins. The invention is especially directed to the preparation of a high viscosity index, low pour point, low cloud point lubricating oil by the catalytic dewaxing of a waxy component-containing lubricating oil stock derived from the oligomerization of a light olefin such as propylene over a zeolite oligomerization catalyst.

Viscosity index (V.I.) is a quality parameter of considerable importance for distillate lubricating oils to be used in automotive engines and aircraft engines which are subject to wide variations in temperature. This Index indicates the rate of change of viscosity with temperature. A high viscosity index, e.g., one of at least about 85, indicates an oil that does not tend to become viscous at low temperature or become thin at high temperatures Measurement of the Saybolt Universal Viscosity of an oil at 100° and 210° F., and referral to correlations, provides a measure of the V.I of an oil. For purposes of the present invention, whenever V.I is referred to, the V.I. as noted in the Viscosity Index tabulations of ASTM D567 published by ASTM, or equivalent, is intended.

Recent developments in zeolite catalysts and hydrocarbon conversion processes have created interest in utilizing olefinic feedstocks, such as petroleum refinery streams rich in lower olefins, for the production of $C_5$+ gasoline, diesel fuel, lube stocks, etc. U.S. Pat. Nos. 3,960,978; 4,021,502; 4,150,062; 4,211,640; 4,227,992; 4,456,779; and, 4,547,612 disclose the conversion of $C_2$–$C_5$ olefins by catalytic oligomerization into heavier hydrocarbons over acidic zeolites catalysts.

U.S. Pat. No. 4,520,221 describes a process for producing high V.I. lubes by oligomerizing light olefins over a ZSM-5 type catalyst, the surface acidity of which has been inactivated by treatment with a suitable base material, e.g., a bulky alkylpyridine such as 2,6-di-tert-butyl pyridine.

U.S. Pat. No. 4,524,232 discloses a combination process for producing high V.I lubricating oils from light olefins employing in separate stages a small pore size zeolite catalyst, e.g., ZSM-23, and an intermediate pore size zeolite catalyst, e.g., ZSM-5.

It is known from U.S. Pat. No. 4,568,786 to catalytically oligomerize light olefin to heavier hydrocarbons in a first stage employing a medium pore acidic zeolite catalyst, e.g., H-ZSM-5, the surface of which has been rendered inactive for acidic reactions by chemisorption of a surface deactivating agent, e.g., a bulky amine such as di-tert-butyl pyridine as disclosed in U.S. Pat. No. 4,520,221, supra. The oligomerized product is then further oligomerized/interpolymerized over a second and/or different acid catalyst, e.g., boron trifluoride or an acidic zeolite such as HZSM-5 which may or not be surface treated, to provide lubricant range hydrocarbons.

In accordance with the olefin oligomerization process described in U.S. patent application Ser. No. 140,361, referred to above, a lower olefin such as propylene is oligomerized in the presence of, as catalyst, acidic ZSM-23 zeolite which has been surface-neutralized by a bulky dialkyl pyridine compound, e.g., 2,4,6-collidine (2,4,6-trimethyl pyridine). As in U.S. Pat. No. 4,568,786, supra, the resulting product is further oligomerized over an acidic oligomerization catalyst such as boron trifluoride or an acidic zeolite such as ZSM-5 to provide lube range materials.

While the lubricating oil stocks obtained by the procedures described in aforesaid U.S Pat. No. 4,568,786 possess desirably high V.I.s, e.g., at least about 85, they also contain significant quantities of waxy components which result in their having high pour points and high cloud points. Removal of at least a portion of these waxy components while retaining the high V.I.s of the oils is necessary in order to provide a lubricating oil product of acceptable low temperature characteristics.

Numerous catalytic dewaxing processes featuring the use of a zeolite hydrodewaxing catalyst have been developed to remove waxy components of a hydrocarbon oil feed by one or more chemical mechanisms such as isomerization and cracking U.S. Pat. No. 4,222,855 describes the use of ZSM-23 and ZSM-35 as hydrodewaxing catalysts for the hydrodewaxing of a lube fraction derived from petroleum, i.e., a distillate fraction boiling within the approximate range of from about 450° to about 1050° F. The hydrodewaxed oil is said to possess a V.I. which is considerably higher than that obtained with ZSM-5 hydrodewaxing catalyst.

Other catalytic hydrodewaxing processes are disclosed in, inter alia, U.S. Pat. No. Re. 28,398 (of original U.S. Pat. No. 3,700,585) and U.S. Pat. Nos. 3,894,938; 4,176,050; 4,181,598; 4,229,282; 4,247,388; 4,259,174; 4,376,036; 4,419,220; 4,472,266; 4,474,618; 4,501,926; 4,541,919; 4,554,065; and, 4,601,993 to mention a few.

SUMMARY OF THE INVENTION

It is an object of the present invention to provide a process for producing a lubricating oil of high viscosity index and low pour and cloud points derived from a catalytically oligomerized lower olefin such as propylene.

It is a particular object of the invention to provide such a lubricating oil in a series of operations in which lower olefin is oligomerized in the presence of a surface-deactivated zeolite having acidic pore activity and a Constraint Index of from about 1 to about 12 to provide an intermediate stage oligomerization product at least a fraction of which is further oligomerized over an acid oligomerization catalyst to provide a waxy component-containing lubricating oil stock which is then catalytically hydrodewaxed employing a particular type zeolite hydrodewaxing catalyst to provide the high viscosity index, low pour point and low cloud point lubricating oil product.

In keeping with the foregoing and other objects of the invention, there is provided a process for producing a high viscosity index, low pour point, low cloud point lubricating oil which comprises:

(a) contacting a feed containing at least one lower olefin with an olefin oligomerization catalyst under olefin oligomerization conditions to produce an intermediate olefin oligomer product, said olefin oligomerization catalyst being a zeolite (1) possessing a Constraint Index of from about 1 to about 12, (2) exhibiting internal acidic pore activity and (3) having a surface which has been at least partially deactivated for acid catalyzed reactions by chemisorption of a surface-deactivating agent the average cross section of which is larger than that of the zeolite pores;

(b) contacting at least a portion of the intermediate olefin oligomer product with an acidic olefin oligomerization catalyst under olefin polymerization conditions to produce a waxy component-containing lubricating oil stock of high viscosity index; and, (c) contacting at least a portion of the waxy component-containing lubricating oil stock with a hydrodewaxing catalyst under hydrodewaxing conditions to produce a dewaxed lubricating oil stock of reduced pour point, said hydrodewaxing catalyst being an acidic zeolite possessing pore openings defined by (1) a ratio of sorption of n-hexane to o-xylene, on a volume percent basis, of greater than about 3, which sorption is determined at a P/Po of 0.1 and at a temperature of 50° C. for n-hexane and 80° C. for o-xylene and (2) the ability to selectively crack 3-methylpentane in preference to 2,3-dimethylbutane at 1000° F. and 1 atmosphere pressure from a 1/1/1 weight ratio mixture of n-hexane/3-methylpentane/2,3-dimethylbutane mixture with the ratio of rate constants $k_{3MP}k/_{DMB}$ being in excess of about 2.

The zeolite hydrodewaxing catalysts employed in the foregoing process have been found to be highly selective catalysts for the dewaxing of oligomerized olefin-based lubricating oil stocks by mechanisms involving both isomerization and cracking.

DESCRIPTION OF THE PREFERRED EMBODIMENTS

The surface acidity-deactivated shape-selective catalysts used in the initial oligomerization step of the process of this invention are derived from acidic crystalline aluminosilicate zeolites having a silica to alumina molar ratio of at least 12 and a Constraint Index of from about 1 to about 12. Representative of such zeolites are ZSM-5, ZSM-11, ZSM-12, ZSM-23, ZSM-35, ZSM-38, ZSM-48 and ZSM-50. Reference may be made to U.S. Pat. No. Re. 29,948 (original U.S. Pat. No. 3,702,886) for ZSM-5; U.S. Pat. No. 3,709,979 for ZSM-11; U.S. Pat. No. 3,832,449 for ZSM-12; U.S. Pat. No. 4,076,842 for ZSM-23; U.S. Pat. No. 4,016,245 for ZSM-35; U.S. Pat. No. 4,046,839 for ZSM-38; U.S. Pat. No. 4,397,827 for ZSM-48; and U.S. Pat. No 4,640,829 for ZSM-50. The contents of these patents are incorporated by reference herein. Other surface-modified pentasil catalysts which can be used in the initial oligomerization step of this invention include those derived from any of a variety of medium pore metallosilicates such as the borosilicates, ferrosilicates, and/or aluminosilicates disclosed in U.S. Pat. Nos. 4,414,423 and 4,417,088, the contents of which are incorporated by reference herein.

Shape-selective oligomerization as it applies to the conversion of $C_2$–$C_{10}$ over ZSM-5 which has not been surface-modified is known to produce higher olefins up to $C_{30}$ and even higher. As reported by Garwood in *Intrazeolite Chemistry* 23, (Amer. Chem. Soc., 1983), reaction conditions favoring higher molecular weight product are low temperature (200°–260° C.), elevated pressure (about 2000 kPa or greater) and long contact time (less than 1 WHSV). The reaction under these conditions proceeds through the acid-catalyzed steps of (1) oligomerization, (2) isomerization-cracking to a mixture of intermediate carbon number olefins, and (3) interpolymerization to give a continuous boiling product containing all carbon numbers. The channel systems of ZSM-5 type catalysts impose shape-selective constraints on the configuration of the large molecules, accounting for the differences with other catalysts.

The following model reaction path for propylene is set forth for purposes of explanation only and should be regarded as a theoretical explanation of a zeolite-catalyzed olefin oligomerization process as presently understood by workers in the field.

(representative structure)

$C_3^=$ (propylene) oligomerization ⟶

$C_6^=$, $C_9^=$, $C_{12}^=$, etc. (Isomerization and cracking ⟶)
($C_3$ oligomers);

$C_3^=$, $C_4^=$, $C_5^=$, $C_6^=$, $C_7^=$, etc.; (Interpolymerization ⟶)

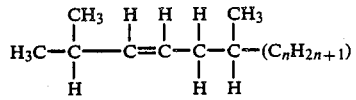

The oligomerization-polymerization products include $C_{10}$+ substantially linear aliphatic hydrocarbons. The ZSM-5 catalytic path for a propylene feed provides a long chain with approximately one lower alkyl (e.g., methyl) substituent per 8 or more carbon atoms in the straight chain. The lubricant range final product can be depicted as a typical linear molecule having a sparingly-substituted (saturated) long carbon chain, as follows:

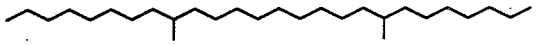

The final molecular conformation is influenced by the pore structure of the catalyst For the higher carbon numbers, the structure is primarily a methyl-branched straight olefinic chain, with the maximum cross section of the chain limited by the 5.4×5.6 Angstrom dimension of the largest ZSM-5 pore. Although emphasis is placed on the normal 1-alkenes as feed stocks, other lower olefins such as 2-butene or isobutylene are readily employed as starting materials due to their rapid isomerization over the acidic zeolite catalyst. At conditions chosen to maximize heavy distillate and lubricant range products (i.e., $C_{20}$+ material), the raw aliphatic product is essentially mono-olefinic. Overall branching is not extensive with most branches being methyl at about one branch per eight or more atoms.

The V.I. of a hydrocarbon lube oil is related to its molecular conformation. Extensive branching in a molecule usually results in a low V.I., i.e., one which is below about 85. It is believed that two modes of oligomerization/polymerization of olefins can take place over acidic zeolites such as H-ZSM-5 One reaction sequence takes place at Bronsted acid sites inside the channels or pores, producing essentially linear materials. The other reaction sequence occurs on the outer surface producing highly branched material which tend to reduce the V.I. of the product. By reducing the surface acid activity (surface alpha value) of such zeolites, fewer highly branched products with low V.I. are obtained.

Several techniques can be used to increase the relative ratio of intra-crystalline acid sites to surface active sites. This ratio increases with crystal size due to the geometric relationship between volume and superficial surface area. Deposition of carbonaceous materials by coke formation can also shift the effective ratio. However, enhanced effectiveness is observed where the surface acid sites of small crystal zeolites are reacted with a chemisorbed organic base or the like. Deactivation of the surface acid catalytic activity of the selected zeolite olefin polymerization catalyst can be accomplished in accordance with known and conventional methods. The extent to which the zeolite can be surface-deactivated can vary over considerable limits, depending on the conditions of the deactivation procedure, and still provide significant improvement over the same zeolite which has not been surface-deactivated. In general, a reduction in surface acid sites on the order of at least about 10%, and preferably at least about 20%, can be readily achieved employing the methods described below.

Zeolite oligomerization catalysts of low surface acid catalytic activity can be obtained by deactivation with basic compounds examples of which include amines, phosphines, phenols, polynuclear hydrocarbons, cationic dyes, and so forth. These compounds have a minimum average cross section diameter of about 5 Angstroms or greater. Examples of suitable amines include monoamines, diamines, triamines, aliphatic and aromatic cyclic amines and heterocyclic amines, porphines, phthalocyanines, 1,10-phenanthroline, 4,7-diphenyl-1,10-phenanthroline, 3,4,8,8-tetramethyl-1, 10-phenanthroline, 5,6-benzoquinoline, 2,2':6',2''-terpyridine, 2,4,6-tri(2-pyridyl)-S-triazine and 2,3-cyclododecenopyridine. Examples of phosphines include triphenylphosphine and I,2-bis(diphenylphosphine)ethane. Suitable phenols are, for example, di-t-butylphenol, alkylated naphthol and 2,4,6-trimethylphenol. Polynuclear hydrocarbons include substances such as pyrene and phenanthrene. Cationic dyes include thionine, methylene blue and triphenylmethane dyes such as malachite green and crystal violet. Another surface modification technique is deactivation by treating with metal compounds. Suitable metal compounds are magnesium acetate, metal-porphines such as hemin or iron (III) porphine chloride cobalticinium chloride $(C_5H_5)_2CoCl$ and titanocene dichloride (biscyclopentadienyl titanium dichloride) and large complex cations such as $[Co(NH_2R)_6]^{2+}$ where R is H or alkyl $[Pt(NH_2R)_4]^{2+}$ where R is alkyl, $[Co(en)_3]^{3+}$ where en is ethylenediamine and manganese (III) meso-tetraphenylporphine.

The oligomerization catalysts can be treated with organic silicon compounds as described in U.S. Pat. Nos 4,100,215 and 4,002,697, the contents of which are incorporated by reference herein, to impart the desired degree of surface deactivation while being essentially free of carbonaceous deposits. Such treatment involves contacting the catalyst with a silane surface-modifying agent capable of deactivating catalytic (acidic) sites located on the external surface of the zeolite by chemisorption. Amines having an effective cross section larger than about 5 Angstroms which are especially suitable for reducing zeolite surface acid catalysis activity include substituted quinolines, heterocyclic amines and alkyl-substituted pyridines such as 2,4- or 2,6-dialkyl pyridines and 2,4,6-trialkyl pyridines. Preferred are bulky, sterically-hindered di-ortho-alkyl pyridines such as 2,6-di-tertiarv-butylpyridine as disclosed in U.S. Pat. No. 4,520,221, referred to supra, the contents of which are incorporated by reference herein, and 2,4,6-collidine as disclosed in aforementioned U.S. patent application Ser. No. 140,361 referred to above.

Prior to use, the zeolite oligomerization catalysts should be at least partially dehydrated. This can be accomplished by heating the zeolite to a temperature in the range of from about 200° to about 600° C. in gaseous atmosphere such as air, nitrogen, etc., at atmospheric or subatmospheric pressure for from about 1 to about 48 hours Dehydration can also be performed at lower temperatures merely using a vacuum but a longer time is required to obtain a sufficient degree of dehydration.

The lower molecular weight $C_6$–$C_{20}$ intermediate stage materials formed over the surface-modified olefin oligomerization catalysts are relatively linear olefins. These olefins can be effectively converted to lube range materials by additional oligomerization. Accordingly, lube range materials are obtained in a two-stage process the first stage of which involves oligomerization of a lower olefin, e.g., propylene, at about 200° C. over a surface acidity-deactivated zeolite olefin oligomerization catalyst, e.g., H-ZSM-5 or H-ZSM-23, and the second stage of which involves further oligomerization-/interpolymerization of the product (or a fraction of the product) resulting from the first stage over a second and/or different acid oligomerization catalyst which, in the case of a zeolite, may be modified or unmodified as disclosed above at about 100°–260° C. The temperature of the second stage is usually lower than that of the first stage, e.g., about 25°–75° C. lower. Both high yields and high V.I.s are achieved by this two-stage operation.

When propylene or butene are oligomerized in the aforedescribed manner, a mixture of liquid hydrocarbon products is formed. More particularly, this mixture of hydrocarbons can comprise at least 95% by weight of monoolefin oligomers of the empirical formula $$C_{(n+nm)}H_{2(n+nm)}$$

where n is 3 or 4 and m is an integer from 1 to 6, said mono-olefin oligomers comprising at least 20 percent by weight of olefins having at least 12 carbon atoms, said olefins having at least 12 carbon atoms having an average of from 0.80 to 2.00 methyl side groups per carbon chain, said olefins not having any side groups other than methyl.

It will be understood that methyl side groups are methyl groups which occupy positions other than the terminal positions of the first and last (i.e., alpha and omega) carbon atoms of the longest carbon chain. This longest carbon chain is also referred to herein as the straight backbone chain of the olefin. The average number of methyl side groups for the $C_{12}+$ olefins can comprise any range within the range of 0.80 to 2.00; e.g., from 0.80 to 1.90; from 0.80 to 1.80; from 0.80 to 1.70; from 0.80 to 1.60; from 0.80 to 1.50; from 0.80 to 1.40; from 0.8 to 1.30, etc.

These oligomers can be separated into two or more fractions by conventional separation procedures including fractional distillation. When propylene is oligomerized, propylene oligomer fractions containing the following numbers of carbon atoms can be obtained: 6, 9, 12, 15 18 and 21. When butene is oligomerized, butylene oligomer fractions containing the following numbers of carbon atoms can be obtained: 8, 12, 16, 20, 24 and 28. It is also possible to oligomerize a mixture of propylene and butene and to obtain a mixture of oligomers having at least 6 carbon atoms.

By fractionating the oligomerization product obtained in the first step of this process, one can obtain a mixture of hydrocarbons, suitable for further oligomerization, comprising at least 95 (e.g., at least 98) percent by weight of mono-olefins having at least 12 carbon atoms. The $C_{12}$ monoolefins have a straight backbone chain of at least 10 carbon atoms, said mono-olefins having an average of from 0.40 to 2.00 (e.g., from 0.50 to 1.90; from 0.60 to 1.80; from 0.70 to 1.70; from 0.80 to 1.60; from 0.80 to 1.50; from 0.80 to 1.40; from 0.80 to 1.30, etc.) methyl side groups per carbon chain. These $C_{12}$ olefins can comprise at least 5 (e.g., from 5 to 40; from 5 to 25, etc.) mole percent dodecene (i.e., a $C_{12}$ olefin having no methyl side groups), at least 30 (e.g., from 30 to 90; from 65 to 80, etc.) mole percent methylundecene (i.e., a $C_{12}$ olefin having one methyl side group) and at least 5 (e.g., from 5 to 40; from 5 to 25, etc.) mole percent dimethyldecene (i.e., a $C_{12}$ olefin having two methyl side groups).

Another useful hydrocarbon fractionation product for further oligomerization can be a mixture of hydrocarbons comprising at least 95 (e.g., at least 98) percent by weight of mono-olefins having at least 15 carbon atoms, said mono-olefins having a straight backbone chain of at least 13 carbon atoms, said mono-olefins having an average of from 0.40 to 2.00 (e.g., from 0.50 to 1.90; from 0.60 to 1.80; from 0.70 to 1.70; from 0.80 to 1.60; from 0.80 to 1.50; from 0.80 to 1.40; from 0.80 to 1.30, etc.) methyl side groups per carbon chain. These $C_{15}$ olefins can comprise at least 5 (e.g., from 5 to 40; from 5 to 25, etc.) mole percent pentadecene (i.e., a $C_{15}$ olefin having no methyl side groups), at least 30 (e.g., from 30 to 90; from 65 to 80, etc.) mole percent methyltetradecene (i.e., a $C_{15}$ olefin having one methyl side group) and at least 5 (e.g., from 5 to 40; from 5 to 25, etc.) mole percent dimethyltridecene (i.e. a $C_{15}$ olefin having two methyl side groups).

Another useful hydrocarbon fractionation product for further oligomerization can be a mixture of hydrocarbons comprising at least 95 (e.g., at least 98) percent by weight of mono-olefins having 16 carbon atoms, said mono-olefins having a straight backbone chain of at least 14 carbon atoms, said mono-olefins having an average of from 0.40 to 2.00 (e.g., from 0.50 to 1.90; from 0.60 to 1.80; from 0.70 to 1.70; from 0.80 to 1.60; from 0.80 to 1.50; from 0.80 to 1.40; from 0.80 to 1.30, etc.) methyl side groups per carbon chain. These $C_{16}$ olefins can comprise at least 5 (e.g , from 5 to 40; from 5 to 25, etc.) mole percent hexadecene (i.e., a $C_{16}$ olefin having no methyl side groups) at least 30 (e.g., from 30 to 90; from 65 to 80, etc.) mole percent methylpentadecene (i.e., a $C_{16}$ olefin having one methyl side group) and at least 5 (e.g., from 5 to 40; from 5 to 25, etc.) mole percent dimethyltetradecene (i.e., a $C_{16}$ olefin having two methyl side groups).

Another hydrocarbon fractionation product which is suitable for further oligomerization can be a mixture of hydrocarbons comprising at least 95 (e.g., at least 98) percent by weight of mono-olefins having 18 carbon atoms, said mono-olefins having a straight backbone chain of at least 16 carbon atoms, said mono-olefins having an average of from 0.40 to 2.00 (e.g., from 0.50 to 1.90; from 0.60 to 1.80; from 0.70 to 1.70: from 0.80 to 1.60 from 0.80 to 1.50: from 0.80 to 1.40: from 0.80 to 1.30, etc.) methyl side groups per carbon chain. These $C_{18}$ olefins can comprise at least 5 (e.g., from 5 to 40; from 5 to 25, etc.) mole percent octadecene (i.e., a $C_{18}$ olefin having no methyl side groups) at least 30 (e.g., from 30 to 90; from 65 to 80, etc.) mole percent methylheptadecene (i.e., a $C_{18}$ olefin having one methyl side group) and at least 5 (e.g., from 5 to 40; from 5 to 25, etc.) mole percent dimethylhexadecene (i.e., a $C_{18}$ olefin having two methyl side groups).

These olefin mixtures, particularly the abovementioned fractionation products, can be used as is or they can be blended with other olefins such as various straight chain olefins (i.e. olefins having no methyl side groups) to provide further olefin mixtures which are suitable for further oligomerization.

Conversion of the initial oligomerizate product or any of the heavier fractions thereof as described above to high V.I. lube range products can be accomplished with any acid catalysts which catalyze ethylenic unsaturation reactions. Catalysts which are suitable for this purpose include H-ZSM-12 as disclosed in U.S. Pat. No. 4,254,295 and large pore zeolites as disclosed in U.S. Pat. No. 4,430,516. particularly suitable are unmodified medium pore acidic zeolites having a Constraint Index of from about 1 to about 12, e.g., H-ZSM-5, preferably of small crystal size (e.g., less than about 1 micron). Also suitable are small pore acidic zeolites, e.g., ZSM-23 and ZSM-34; large pore acidic zeolites, e.g., mordenite; synthetic faujasite; crystalline silica-aluminophosphates; amorphous silica-alumina; acid clays; organic cation exchange resins, such as cross linked sulfonated polystyrene; and, Lewis acids such as $BF_3$ and $AlCl_3$ containing suitable co-catalysts such as water, alcohols, carboxylic acid or hydrogen halides.

As previously indicated, the lube range materials herein contain significant quantities of waxy components which must be removed to reduce the pour point and cloud point of the final product to acceptable levels without significantly reducing its high V.I In some instances, it may be desirable to partially dewax the lubricating oil stock by conventional solvent dewaxing techniques prior to catalytic dewaxing.

In general, the catalytic hydrodewaxing conditions include a temperature between about 500° and about 850° F., a pressure between about 100 and about 3000 psig and preferably between about 200 and about 1000 psig. The liquid hourly space velocity is generally between about 0.1 and about 10 and preferably between about 0.5 and about 4 and the hydrogen to feedstock ratio is generally between about 400 and about 8000 and preferably between about 800 and about 4000 standard cubic feed (scf) of hydrogen per barrel of feed.

The catalytic hydrodewaxing process of this invention can be conducted by contacting the waxy component-containing lubricating oil stock with a fixed stationary bed of the zeolite hydrodewaxing catalyst or with a transport bed as may be desired. A simple, and therefore preferred, configuration is a trickle-bed operation in which the feed is allowed to trickle through a stationary fixed bed, preferably in the presence of hydrogen. With such configuration, it is advantageous to initiate the reaction with fresh catalyst at a temperature of less than 600° F. This temperature is, of course, raised as the catalyst ages in order to maintain catalytic activity. In general, the dewaxing operation is terminated at an end-of-run temperature of about 850° F. at which time the zeolite catalyst can be regenerated, e.g., by contact at elevated temperature with hydrogen gas.

Of the zeolite hydrodewaxing catalysts which can be used herein to effect the pour and cloud point reduction of the olefin oligomer-based lubricating oil stock, H-ZSM-23 and H-ZSM-35 are preferred. These zeolites, which are characterized by pore openings smaller than those of ZSM-5, ZSM-11 or ZSM-12 and larger than those of erionite or zeolite ZK-5, have been found to provide superior results in the hydrodewaxing of waxy component-containing olefin oligomer-based lube materials to provide high V.I., low pour point and low cloud point lubricating oil products ZSM-23 is described in U.S. Pat. No. 4,076,842, the entire contents of which are incorporated by reference herein.

ZSM-35 is described in U.S. Pat. No. 4,016,245, the entire contents of which are incorporated by reference herein.

In the following table, the sorption ratio (volume %) of n-hexane/o-xylene at a temperature of 50° C. and P/P of 0.1 for the sorption of the sorption of n-hexane and 80° C. and P/P of 0.1 for o-xylene together with the rate constant ratio $k_{3MP}/k_{DMB}$, above defined, are shown for ZSM-23, ZSM-35, ZSM-5 and ZSM-11

TABLE I

| | ZSM-23 | ZSM-35 | ZSM-5 | ZSM-11 |
|---|---|---|---|---|
| n-hexane/o-xylene | 3.3 | 5.8 | 2.5 | 1.6 |
| $k_{3MP}/k_{DMB}$ | 11 | 6.3 | 1.5 | 1.5 |

It will be evident from the above that ZSM-23 and ZSM-35 satisfy the criteria for zeolites which can be used in the catalytic hydrodewaxing step of the process of this invention since they possess an n-hexane/o-xylene sorption ratio of greater than about 3 and a $k_{3MP}/k_{DMB}$ ratio of greater than about 2 whereas ZSM-5 and ZSM-11 do not meet these requirements.

The original cations associated with the zeolite olefin oligomerization and/or hydrodewaxing catalysts utilized herein can be replaced by a wide variety of other cations employing procedures which are well known in the art. Typical replacing cations include hydrogen, ammonium and metal cations and mixtures thereof. Of the replacing metallic cations, particular preference is given to cations of metals such as rare earth metals, manganese, calcium as well as metals of Group II of the Periodic Table, e.g., zinc, and Group VIII of the Periodic Table, e.g., nickel, platinum and palladium Thus, e.g., Pt/H-ZSM-23 and Pt/H-ZSM-35 are especially preferred for use in the catalytic hydrodewaxing step of this invention as they result in simultaneous dewaxing-/hydrogenation of the waxy lube stock feed.

Typical ion exchange techniques would be to contact the particular zeolite with a salt of the desired replacing cation. Although a wide variety of salts can be employed, particular preference is given to chlorides, nitrates and sulfates.

Representative ion exchange techniques are disclosed in a number of patents including U.S. Pat. Nos. 3,140,249; 3,140,251; and, 3,140,253.

Following contact with a solution of the desired replacing cation, the zeolite is then preferably washed with water and dried at a temperature ranging from about 150° F. to about 600° F. and thereafter calcined in air or other inert gas at temperatures ranging from about 500° F. to about 1500° F. for periods of time ranging from about 1 to about 48 hours or more. It has been further found that catalysts of improved selectivity and other beneficial properties may be obtained by subjecting the zeolites to treatment with steam at elevated temperatures ranging from about 800° F. to about 1500° F. and preferably from about 1000° F. to about 1400° F. The treatment may be accomplished in atmospheres of 100% steam or an atmosphere consisting of steam and a gas which is substantially inert to the zeolites. A similar treatment can be accomplished at lower temperatures and elevated pressure, e.g., from about 350° to about 700° F. at from about 10 to about 200 atmospheres.

As in the case of the zeolite olefin oligomerization catalysts, supra, the zeolites employed in the hydrodewaxing step should be at least partially dehydrated before use, e.g., utilizing the previously stated conditions.

It can be advantageous to incorporate the zeolites which are used herein into some other material, i.e., a matrix or binder, which is resistant to the temperatures and other process conditions. Useful matrix materials include both synthetic and naturally-occurring substances, e.g., inorganic materials such as clay, silica and/or metal oxides. Such materials can be either naturally-occurring or can be obtained as gelatinous precipitates or gels including mixtures of silica and metal oxides. Naturally occurring clays which can be composited with the zeolite include those of the montmorillonite and kaolin family, which families include the subbentonites, and the kaolins commonly known as Dixie, McNamee, Georgia and Florida clays or others in which the main mineral constituent is halloysite, kaolinite, dickite, nacrite, or anauxite. Such clays can be used in the raw state as originally mined or initially subjected to calcination, acid treatment or chemical modification.

In addition to the foregoing materials, the zeolites can be composited with a metal oxide binder material such as alumina, titania, zirconia, silica, silica-alumina, silica-magnesia, silica-zirconia, silica-thoria, silica-beryllia, silica-titania, etc., as well as ternary oxide composition, such as silica-alumina-thoria, silica-alumina-zirconia, silica-alumina-magnesia, silica-magnesia-zirconia, etc. The matrix can be in the form of a cogel. It may also be advantageous to provide at least part of the metal oxide binder, e.g., an amount representing from about 1 to about 100 weight percent and preferably from about 2 to about 60 weight percent of total binder, in colloidal form so as to facilitate the extrusion of the bound zeolite.

The relative proportions of zeolite and refractory oxide binder or other material on an anhydrous basis can vary widely with the zeolite content ranging from between about 1 to about 99 weight percent, and more usually in the range of from about 20 to about 80 weight percent, of the dry composite. The relative proportions of zeolite component and binder material, on an anhydrous basis, can vary widely with the zeolite content ranging from between 1 to about 99 wt. %, and more usually in the range of about 5 to about 90 wt. % of the dry composite The following examples will serve to illustrate the process of the invention without limiting the same.

EXAMPLE 1

This example illustrates the preparation of a propylene oligomer-based waxy lubricating oil stock for use as feed in the catalytic hydrodewaxing operations illustrated in Examples 2 to 4.

The propylene was oligomerized over 2,4 6-collidine-modified H-ZSM-23 at 200° C., 800 psig, and WHSV of 0.25 $hr^{-1}$. The product, consisting of $C_1$–$C_{30}$ olefins, was distilled and the $\geqq C_{12}$ fraction was oligomerized over H-ZSM-5 at 175° C. and 0.1 $hr.^{-1}$ WHSV. This product was distilled and the 700° F.+ fraction had the following properties:

| | |
|---|---|
| Kinematic viscosity @ 100° C. (cSt) | 4.47 |
| Viscosity Index | 137 |
| Pour Point | −20 |
| Cloud Point | +30 |

EXAMPLE 2

A Pt/ZSM-23 catalyst containing 0.22 wt. % Pt was activated by drying over nitrogen for 1 hour at 700° F. followed by reduction over hydrogen at 700° F. for six hours 60 gm of the waxy lube feedstock of Example 1 and 8 gm of the activated Pt/H-ZSM-23 catalyst were charged to a 450 cc autoclave reactor. Agitation was started and hydrogen was added to bring the system pressure to 400 psig. The system was heated to 260°–290° C. (500°–550° F.) and opened to a hydrogen cylinder to maintain pressure at 400 psig. The reaction was carried out for 48 hours after which the system was cooled and vented. The liquid product was decanted/-filtered away from the catalyst, distilled, the 700° F.+ product having the following properties:

| | |
|---|---|
| Kinematic viscosity @ 100° C. (cSt) | 4.69 |
| Viscosity Index | 123 |
| Pour Point | −50 |
| Cloud Point | <−50 |

These data indicate a substantial improvement in the low temperature properties of the lube base stock feed with very little reduction in the viscosity index of the lube base stock. The product was also analyzed for olefin content via NMR and by shaking with concentrated sulfuric acid. No olefins were detected thus indicating that single-step dewaxing/hydrogenation had been achieved.

EXAMPLE 3

61 gm of the lube feedstock of Example 1 and 7.9 gm of the Pt/H-ZSM-23 catalyst of Example 2 were charged to a 450 cc autoclave reactor. Agitation was started and hydrogen was added to bring the system pressure to 200 psig. The system was heated to 275° C. (525° F.) and opened to a hydrogen cylinder to maintain pressure at 420 psig. The reaction was carried out for 12 hours after which the system was cooled and vented. The liquid product was decanted/filtered away from the catalyst, distilled, the 700° F.+ product having the following properties:

| | |
|---|---|
| Kinematic viscosity @ 100° C. (cSt) | 4.60 |
| Viscosity Index | 133 |
| Pour point | −50 |
| Cloud Point | −35 |

As in Example 2, these data demonstrate a substantial improvement in the low temperature properties of the lube base stock feed.

EXAMPLE 4

60.4 gm of the lube feedstock of Example 1 and 7.5 gm of Ni/H-ZSM-5 catalyst were charged to a 450 cc autoclave reactor. Agitation was started and hydrogen was added to bring the system pressure to 200 psig. The system was heated to 275° C. (525° F.) and opened to a hydrogen cylinder to maintain pressure at 440 psig. The reaction was carried out for 10 hours after which the system was cooled and vented. The liquid product was decanted/filtered away from the catalyst, distilled, the 700° F.+ product having the following properties:

| | |
|---|---|
| Kinematic viscosity @ 100 ° C. (cSt) | 6.58 |
| Viscosity Index | 79 |
| Pour Point | −40 |
| Cloud Point | −45 |

Unlike Examples 2 and 3 in which the V.I. of the lube feedstock was scarcely effected by hydrodewaxing over acidic ZSM-23, this example shows that with acidic ZSM-5, an unacceptable reduction in V.I. resulted from the use of this zeolite.

What is claimed is:

1. A process for producing a high viscosity index, low pour point, low cloud point lubricating oil which comprises:

(a) contacting a feed containing at least one lower olefin with an olefin oligomerization catalyst under olefin oligomerization conditions to produce an intermediate olefin oligomer product, said olefin oligomerization catalyst being a zeolite (1) possessing a Constraint Index of from about 1 to about 12, (2) exhibiting internal acidic pore activity and (3) having a surface which has been at least partially deactivated for acid catalyzed reactions by chemisorption of a surface-deactivating agent the average cross section of which is larger than that of the zeolite pores;

(b) contacting at least a portion of the intermediate olefin oligomer product with an acidic olefin oligomerization catalyst under olefin polymerization conditions to produce a waxy component-containing lubricating oil stock of high viscosity index; and, (c) contacting at least a portion of the waxy component-containing lubricating oil stock with a hydrodewaxing catalyst under hydrodewaxing conditions to produce a dewaxed lubricating oil stock of high viscosity index and reduced pour point and cloud point, said hydrodewaxing catalyst being an acidic zeolite possessing pore openings defined by a ratio of sorption of n-hexane to o-xylene, on a volume percent basis, of greater than about 3, which sorption is determined at a P/Po of 0.1 and at a temperature of 50° C. for h-hexane and 80° C. for o-xylene and (2) the ability to selectively crack 3-methylpentane in preference to 2,3-dimethylbutane at 1000° F. and 1 atmosphere pressure from a 1/1/1 weight ratio mixture of n-hexane/3-methylpentane/2,3- dimethylbutane mixture with the ratio of rate constants $k_{3MP}k/_{DMB}$ being in excess of about 2 and selected from the group consisting of H-ZSM-23 and H-ZSM-35.

2. The process of claim 1 wherein the olefin oligomerization catalyst in step (a) is at least one acidic zeolite selected from the group consisting of H-ZSM-5, H-ZSM-11, H-ZSM-12, H-ZSM-23, H-ZSM-35, H-ZSM-38, H-ZSM-48, H-ZSM-50 and the natural forms and analogs thereof.

3. The process of claim 1 wherein the surface-deactivating agent is a sterically-hindered amine.

4. The process of claim 1 wherein the surface-deactivating agent is selected from the group consisting of dialkylamine and trialkylamine.

5. The process of claim 1 wherein the surface-deactivating agent is selected from the group consisting of di-tert-butyl pyridine and 2,4,6-collidine.

6. The process of claim 1 wherein the olefin is selected from the group consisting of propylene and butylene.

7. The process of claim 1 wherein the intermediate olefin oligomerization product is subjected to a fractionation operation to yield a heavy fraction rich in linear $C_{10}+$ olefins for subsequent further oligomerization in step (b) and a light fraction for recycle to oligomerization in step (a).

8. The process of claim 1 wherein the acidic olefin oligomerization catalyst in step (b) is selected from the group consisting of zeolite, amorphous silica-alumina, acid clays, organic cation exchange resin and Lewis acid.

9. The process of claim 1 wherein the acidic olefin oligomerization catalyst in step (b) is H-ZSM-5.

10. The process of claim 1 wherein in step (c), said contacting is effected in the presence of hydrogen and said zeolite is associated with a hydrogenation metal.

11. The process of claim 10 wherein said hydrogenation metal is selected from the group consisting of platinum, palladium and zinc.

12. The process of claim 1 wherein in step (c), the acidic zeolite is associated with a hydrogenation metal, the acidic zeolite being selected from the group consisting of H-ZSM-23 and H-ZSM-35.

13. The process of claim 1 wherein in step (c), the zeolite is selected from the group consisting of H-ZSM-23 and H-ZSM-35, said zeolite being associated with at least one hydrogenation metal selected from the group consisting of platinum, palladium and zinc.

14. A process for converting propylene to a high viscosity index, low pour point, low cloud point lubricating oil which comprises:

(a) contacting a feed containing propylene with an acidic, surface-deactivated zeolite olefin oligomerization catalyst selected from the group consisting of H-ZSM-5, H-ZSM-11, H-ZSM-12, H-ZSM-23, H-ZSM-35, H-ZSM-38, H-ZSM-48, H-ZSM-50 and the natural forms and analogs thereof under olefin oligomerization conditions to provide an intermediate propylene oligomerization product of which at least 20 weight percent is a fraction made up of mono-olefin oligomers possessing at least 10 carbon atoms;

(b) contacting at least a portion of said fraction of the intermediate propylene oligomerization product with an acidic olefin oligomerization catalyst under olefin polymerization conditions to produce a waxy component-containing lubricating oil stock of high viscosity index; and, (c) contacting at least a portion of the waxy component-containing lubricating oil stock with a hydrodewaxing acidic zeolite catalyst selected from the group consisting of H-ZSM-23 and H-ZSM-35 under hydrodewaxing conditions to produce a dewaxed lubricating oil stock of high viscosity index and reduced pour point and cloud point.

15. The process of claim 14 wherein the intermediate propylene oligomerization product is fractionated to provide a relatively light fraction and a relatively heavy fraction, at least a portion of said heavy fraction being employed as feed in oligomerization step (b).

16. The process of claim 15 wherein the heavy fraction is rich in linear $C_{10}+$ olefins.

17. The process of claim 14 wherein in step (c), the zeolite is associated with a hydrogenation metal.

18. The process of claim 17 wherein the hydrogenation metal is selected from the group consisting of platinum, palladium and zinc.

* * * * *